US008703275B2

(12) United States Patent
Reichwein et al.

(10) Patent No.: US 8,703,275 B2
(45) **Date of Patent: *Apr. 22, 2014**

(54) ADHESIVELESS DECORATIVE FLOOR TILE

(75) Inventors: David P. Reichwein, Elizabethtown, PA (US); Keith A. Pocock, Shanghai (CN)

(73) Assignee: GIP International Limited, Central Hong Kong, SAR PRC (HK)

( * ) Notice: Subject to any disclaimer, the term of this patent is extended or adjusted under 35 U.S.C. 154(b) by 325 days.

This patent is subject to a terminal disclaimer.

(21) Appl. No.: 13/165,246

(22) Filed: Jun. 21, 2011

(65) Prior Publication Data

US 2012/0324805 A1 Dec. 27, 2012

(51) Int. Cl.

| | |
|---|---|
| ***B32B 3/00*** | (2006.01) |
| ***B32B 1/00*** | (2006.01) |
| ***B32B 3/12*** | (2006.01) |

(52) U.S. Cl.
USPC ..... 428/156; 428/174; 428/178

(58) Field of Classification Search
USPC ..... 428/156, 174, 178, 158, 159, 160, 172, 428/187, 99; 15/215; 4/581, 582, 583; 5/417; 52/506.01, 578
See application file for complete search history.

(56) References Cited

U.S. PATENT DOCUMENTS

| | | | | |
|---|---|---|---|---|
| 2,081,992 | A | 3/1936 | Gavlak | |
| 4,698,258 | A | 10/1987 | Harkins, Jr. | |
| 5,059,474 | A | 10/1991 | Yoshida | |
| RE34,357 | E | 8/1993 | Eckert et al. | |
| 6,006,486 | A | 12/1999 | Moriau et al. | |
| 6,014,779 | A | 1/2000 | Lindholm | |
| 6,167,879 | B1 | 1/2001 | Sievers et al. | |
| 6,287,664 | B1 | 9/2001 | Pratt | |
| 6,656,562 | B2 * | 12/2003 | Malpass et al. | 428/99 |
| 6,851,241 | B2 | 2/2005 | Pervan | |
| 7,155,871 | B1 | 1/2007 | Stone et al. | |
| 7,906,191 | B2 | 3/2011 | Pratt | |
| 8,298,650 | B2 * | 10/2012 | Reichwein et al. | 428/156 |
| 2005/0037177 | A1 | 2/2005 | Streeton et al. | |
| 2005/0100711 | A1 | 5/2005 | Malpass et al. | |
| 2009/0077917 | A1 | 3/2009 | Lai | |
| 2011/0076457 | A1 | 3/2011 | Reichwein et al. | |
| 2011/0183101 | A1 | 7/2011 | Voith et al. | |

FOREIGN PATENT DOCUMENTS

| | | |
|---|---|---|
| CN | 2392845 | 8/2000 |
| CN | 201318011 | 9/2009 |
| DE | 202006009037 | 8/2006 |
| JP | 11172906 | 6/1999 |
| KR | 1020070076671 | 7/2007 |

* cited by examiner

*Primary Examiner* — Catherine A Simone
(74) *Attorney, Agent, or Firm* — Duane Morris LLP

(57) ABSTRACT

A decorative floor tile including at least one decorative layer and a backing layer having an array of resilient annular projections. Each annular projection includes a concave top surface, an outside wall surface, and an inside wall surface. The inside wall surface defines a central, blind passageway area. When the decorative floor tile is installed over an underlying surface, and pressure is applied to the decorative floor tile, a vacuum is created within the blind passageway and the underlying surface. The vacuum increases the amount of frictional drag between the surface covering and the underlying surface, and thus allows the surface covering to remain in place without the need for an adhesive.

11 Claims, 4 Drawing Sheets

ADHESIVELESS DECORATIVE FLOOR TILE

FIELD OF THE INVENTION

The present invention relates to decorative surface covering, including flooring materials.

BACKGROUND OF THE INVENTION

Sub-floor surfaces are often covered with resilient flooring products using adhesives. Such adhesives may be applied directly to the sub-floor, or to the back of the resilient tile products by the manufacturer. Flooring products often stay in place during use, and can be subjected to walking forces, dragging forces, rolling load forces, indentation forces, and sub-floor movement due to dimensional instability. Flooring products must stay flat, not curl. Seams, especially between tiles, must not move or open. There have been many attempts to develop flooring products that do not require adhesives. Some involve so-called "loose lay" constructions as taught in U.S. Pat. Nos. 4,698,258 and RE34,357. Many interlocking tile designs have been the subject of prior art patents. Recently, U.S. Pat. No. 7,155,871 discloses two-sided ship-lap vinyl plank with adhesive located on the ship-lap surface. However, none of these tile technologies have had significant commercial success. There remains a need for resilient decorative floor tiles that do not require adhesives.

Suction cups have been utilized in bath mat constructions as defined in U.S. Pat. Nos. 6,014,779 and 2,081,992, and U.S. Patent Application No. 2005/0100711. While this approach provides acceptable slip-resistance for light shower and bath mat applications, traditional suctions cups do not provide sufficient anti-skidding forces to prevent slippage do to movement in high traffic and high load areas. Traditional suction cups often yield a wavy mat surface which is more difficult for individuals and loads to traverse.

SUMMARY OF THE INVENTION

The present invention provides an adhesiveless decorative floor tile that includes at least one decorative layer and a backing layer. An array of resilient annular projections are located on an outer surface of the backing layer. Each annular projection defines a blind passageway arranged so that when pressure is applied to the decorative layer, a partial vacuum is formed within each blind passageway allowing the decorative floor tile to remain in place on a surface in the absence of adhesive. When the decorative floor tile is installed over an underlying surface, e.g., a sub-floor the vacuum increases the amount of frictional drag between the decorative tile and the underlying surface, thus allows the decorative tile to remain in place without the need for an adhesive.

DETAILED DESCRIPTION OF PREFERRED EMBODIMENTS

In one preferred embodiment of the invention, a decorative floor tile includes at least one decorative layer and a backing layer comprising an array of resilient annular projections, wherein each annular projection comprises a concave exposed top surface, an outside wall surface and an inside wall surface. The inside wall surface defines a blind passageway within the projection. When the decorative floor tile is installed over an underlying surface, and pressure is applied to the decorative floor tile, a vacuum is created within the blind passageway of the projections which adheres the floor tile to the underlying surface. The vacuum increases the amount of frictional drag between the tile and the underlying surface, and thus allows the tile to remain in place without the need for an adhesive.

Figure 1:
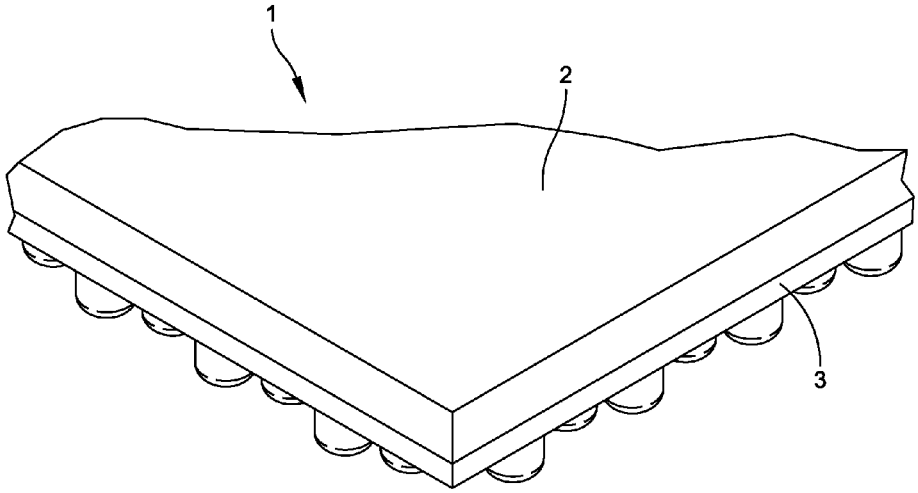
FIG. 1 is a perspective view of one embodiment of a decorative floor tile of the invention.
Figure 2:
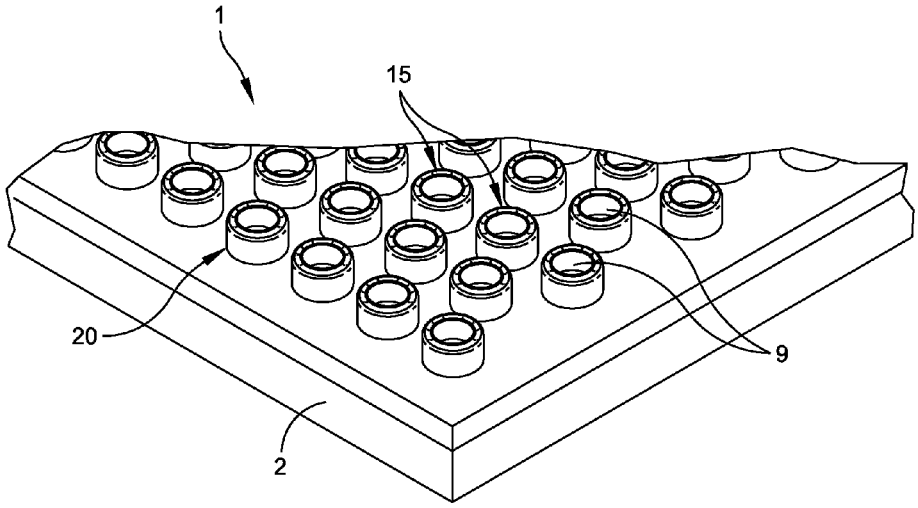
FIG. 2 is a broken-away perspective view of a decorative floor tile showing a backing layer including a plurality of annular projections arranged in an array.

Referring to FIGS. 1 and 2, a decorative floor tile 1 formed in accordance with one embodiment of the invention includes a decorative layer 2, e.g., a 15.3 cm×91.5 cm, Luxury Vinyl Tile Plank, and an elastomeric backing layer 3. having an array 4 of annular projections 5 on the exposed surface. In one embodiment, decorative layer 2 is a flooring material. In another embodiment, decorative layer 2 is selected from the group including a resilient tile, plank, or sheet structure, and laminate plank or tile structure. In a further embodiment, decorative layer 2 is an 18"×18" Luxury Vinyl Tile. In yet another embodiment, the decorative layer 2 is an interlocking Laminate product.

Figure 3:
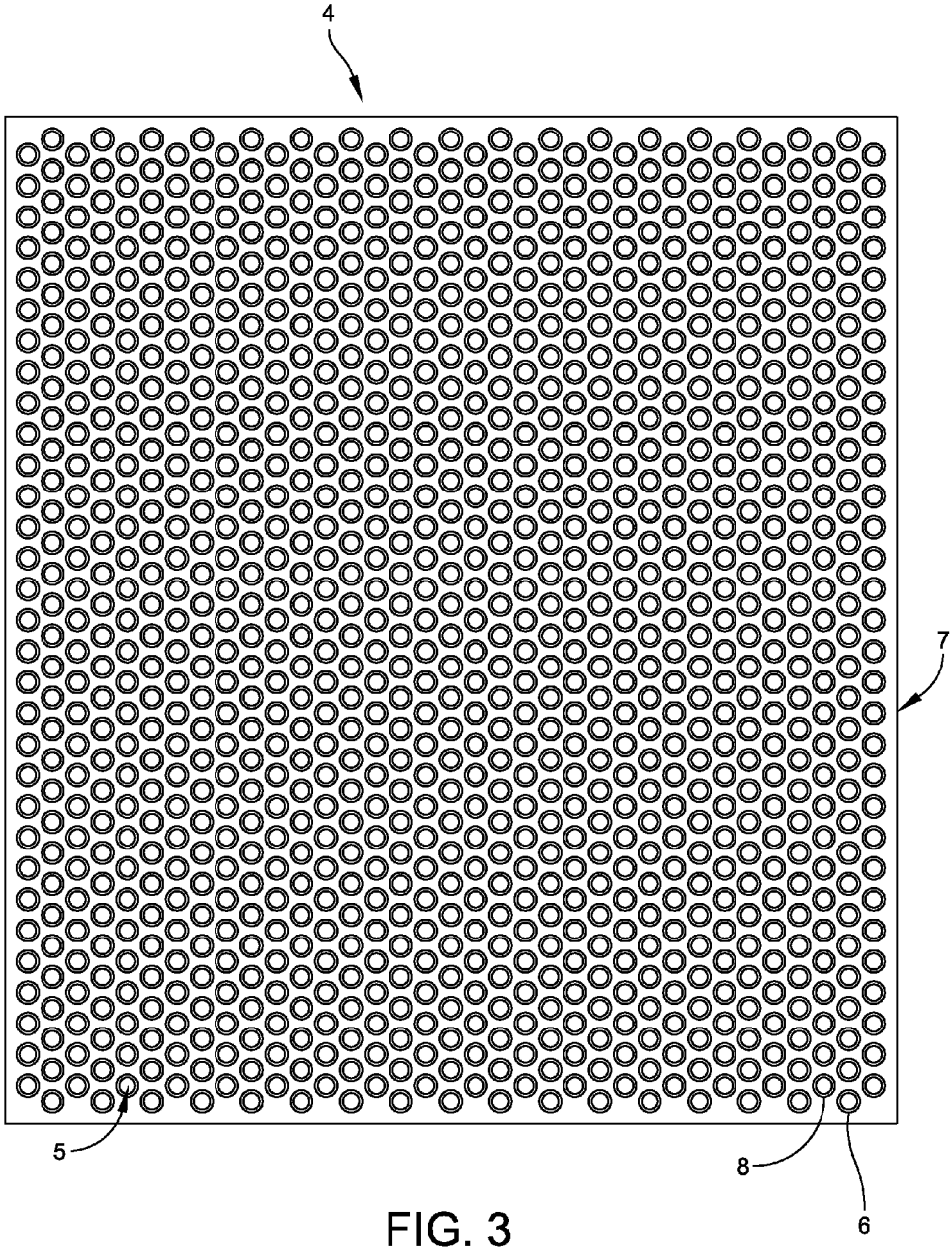
FIG. 3 is a plan view of one embodiment of a patterned array of resilient, annular projections on an exposed face of a backing layer.
Figure 4:
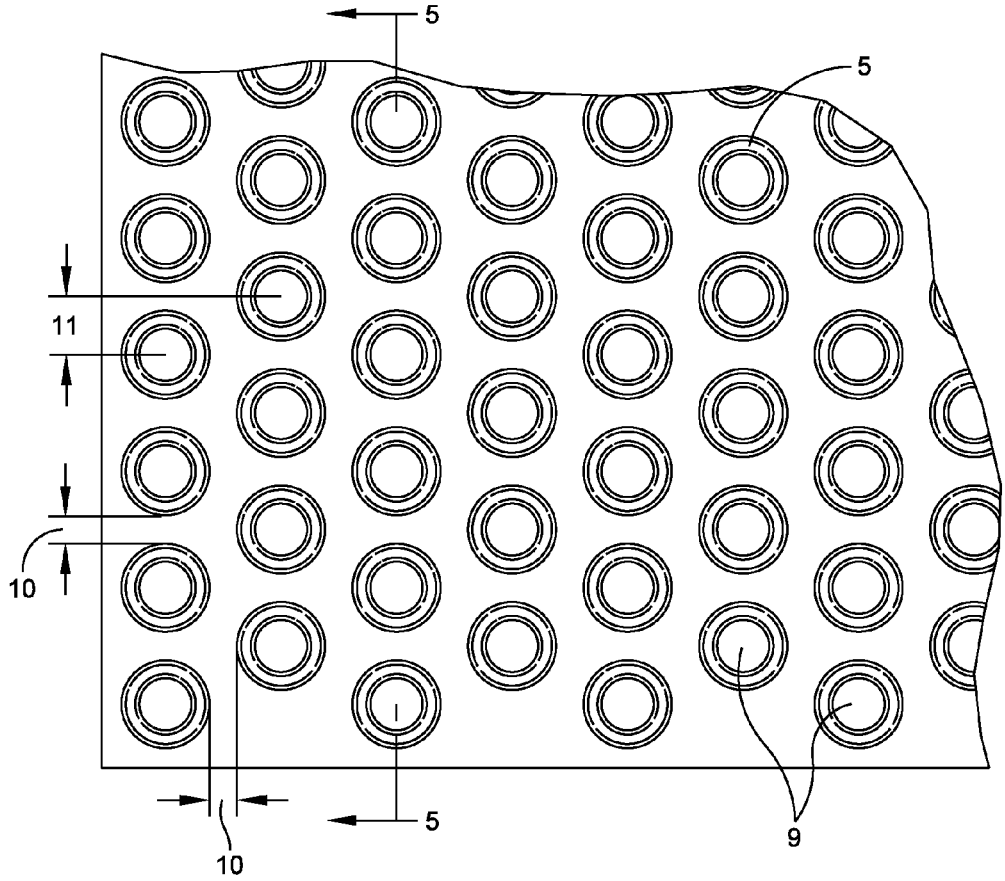
FIG. 4 is an exploded, fragmentary plan view of an array shown in FIG. 2.
Figure 5:
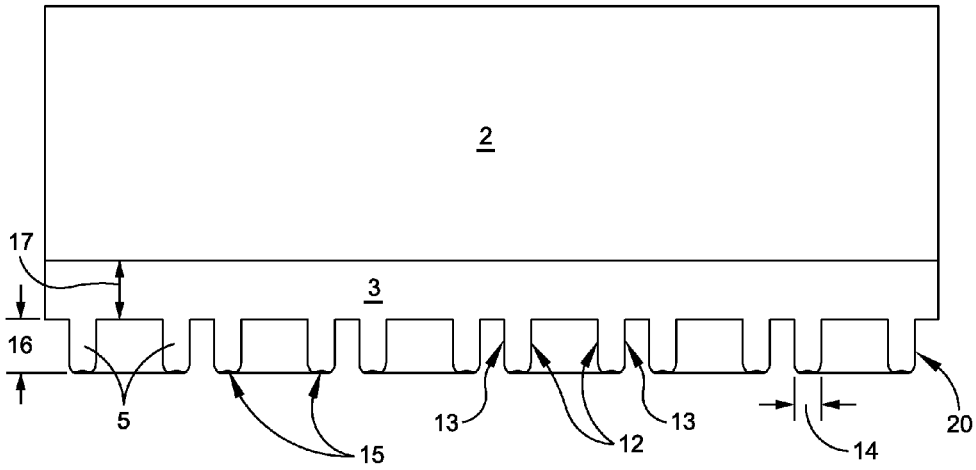
FIG. 5 is a cross-sectional view according to line I-I of FIG. 4.
Figure 6:
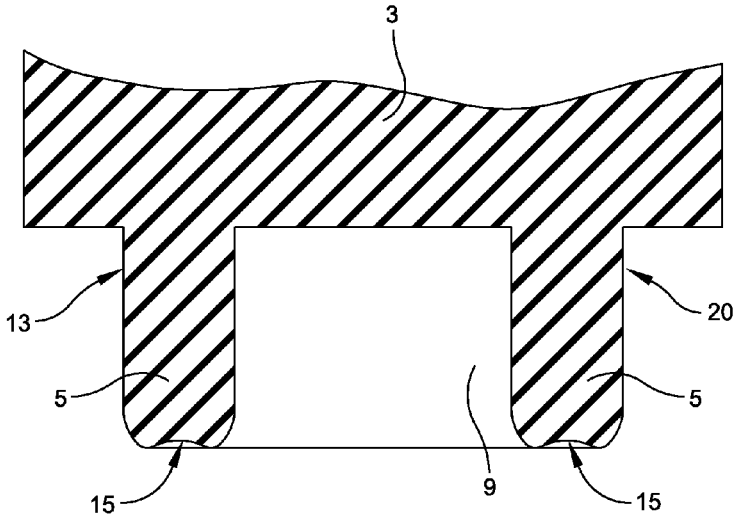
FIG. 6 is a broken-away, cross-sectional view of an annular projection.

Array 4 of annular projections 5 is often organized in rows 6 that are parallel to the decorative layer's longitudinal edge 7, with alternating rows 8 offset on center across the width of the array. Referring to FIGS. 3-4, in a preferred embodiment annular projections 5 each comprise a substantially cylindrical blind tube that defines an internal passageway 9 Annular projections 5 are best formed from materials that are able to spring back quickly into shape after being bent, stretched, or squashed, i.e., resilient materials that are capable of storing and releasing energy. Elastomeric compounds are one such resilient material that has been found to yield acceptable results when incorporated with the structures of the present invention.

In preferred embodiments of the invention, the distance 10 between annular projections 5 within the rows, and between the rows 10', is between about 1.0 mm-1.2 mm with the alternating rows off-set 11 between about 2.4 mm-2.6 mm on center across the width of the array Annular projections 5 are preferably defined by an inside surface 12 and an outside surface 13, that together define a ring wall 20 of projection 5. The inside diameter of passageway 9 defined by inside surface 12 is often in the range from about 1.9 mm-2.1 mm. The outside diameter of each annular projection 5 is often in the range from about 3.7 mm-4.0 mm" resulting in a ring wall thickness 14 of between 0.75 mm-1.2 mm. An exposed, top edge 15 of each ring wall 20 defines a concave surface. Each annular projection preferably has a height 16 in the range from about 0.8 mm-1.2 mm above the surface of backing layer 3 which has a thickness 17 in the range from about 0.13 mm-0.17 mm. Annular projections 5 may also comprise, triangles, squares, rectangles, ovals, pentagons, hexagons, other polygons, or mixtures thereof.

It is within the scope of this invention to change size, number, shape, and dimensions of the annular projections 5 depending upon size and shape of the decorative layer 2. In principle, annular projections 5 should be located as close to the edges of the tile as practically possible to ensure seam integrity. Additionally, these parameters must be carefully controlled to ensure that the resulting product performs acceptably without adhesive: in particular, during exposure to traffic/walking and rolling loads after installation. In some embodiments, annular projections 5 are symmetrical with dimensions equal in both longitudinal and transverse directions providing maximum adhesion in both directions. In other embodiments, annular projections 5 have the shape of ovals, rectangles, or other geometric shapes with zero, or only one axis of symmetry, and they have a symmetry ratio between major dimension (length) and minor dimension (width) through the "center of figure" of about 6.4 cm or less. In another embodiment, the symmetry ratio is about 3.8 cm or less.

The distribution of annular projections 5 and the relative size of internal passageways 9 on backing layer 3 determine the increase in adhesion to the underlying surface that will be produced by the vacuum formed between each internal passageway 9 and backing layer 3. The number of annular projections 5 on the exposed surface of backing layer 3 is in the range from about 2,000 to about 6,000 per square foot. Often, the size of internal passageway 9 has a maximum horizontal dimension from a vertical sidewall through the "center of figure" of annular projections 5 to the opposite vertical sidewall in the range of 0.05 cm to 0.65 cm. The maximum horizontal dimension of internal passageways 9, where the decorative layer is resilient flooring, is in the range of 0.05 cm to 0.33 cm. In some embodiments, the width 14 of annular projections 5 can also be varied, but is generally in the range of 0.04 cm to 0.25 cm. Additionally, the ratio of the maximum dimension of internal passageway 9 to width 14 of annular projections 5 is typically in the range of about 1.5-3.0. Also, in some embodiments the height 16 of annular projections 5 is between 0.01 cm-0.02 cm, and in other embodiments height 16 may be in a range between 0.0076 cm-0.00127 cm. Height 16 of annular projections 5 is important in defining the volume of internal passageway 9, and the ability to create a vacuum when compression is applied to the decorative floor tile. Additionally, concave surface 15 of annular projections 5 which is normally in physical contact with the underlying subfloor facilitates creation of a vacuum during compression. However, in less preferred embodiments surface 15 may be flat, i.e., non-concave. This flat region is located near the center of the surface 15 and not adjacent either vertical wall 12, 13 of annular projections 5.

Any elastomeric composition that is compatible with the decorative layer 2 may be selected for the backing layer. Typical elastomeric compounds, provide acceptable physical performance, and possess adequate coefficient of friction properties to maintain the decorative floor tile in place without adhesive. In one embodiment the elastomeric composition is a flexible vinyl composition including plasticized pvc or pvc/polymeric blend. In another embodiment, rubber materials including thermoplastic and thermoset rubber compositions are employed. The rubber compositions can include, but are not limited to natural or synthetic rubbers, acrylic elastomers, polyester elastomers, polyurethane elastomers, pvc elastomers, polyolefin elastomers, and blends of these materials. The elastomers can comprise homo-polymers, co-polymers, ter-polymers, block co-polymers or blends thereof.

Decorative layer 2 may be traditional Laminate flooring products having a decorative layer. Some examples include the interlocking type of Laminate products, and laminate flooring products such as those described in U.S. Pat. Nos. 6,851,241, and 6, 006,486 which have found commercial success as "free floating" flooring. These flooring products employ a foam underlayment between the laminate product and the underlying sub-floor. In some cases, the foam underlayment can be attached to the underside of the laminate product by the manufacturer. We have discovered that utilizing the backing layer 3 of the current invention in place of the traditional foam has advantages over the prior art. The backing layer 2 of the current invention not only helps to keep the laminate in place, but also provides some improvement in impact sound and transmitted sound properties. The laminate product structure has increased thickness and stiffness, and show-through of the geometric array of backing layer 3 is less of an issue. In the case of Laminate products as decorative layer 2, height 16 may often be increased. In one embodiment annular projections 5 height 16 is in the range of 0.0076 cm-0.1016 cm. In another embodiment, the projection height 16 is in the range of 0.0076 cm-0.00508 cm.

The process of manufacturing a decorative floor tile in accordance with one embodiment of the invention involves the following steps: 1) selecting a decorative layer 2, for example a 6"×36" Luxury Vinyl Tile Plank; 2) designing a patterned array 4 of annular projections 5 to fit size and properties of the selected decorative layer 2; 3) manufacturing backing layer 3 comprising the array of annular projections 5; and laminating the backing layer to the decorative layer to produce the product of this invention. In some instances, the third step involves making a metal plate or mold that is a "negative" of the array of Step 2), applying an elastomeric composition onto the metal plate or mold, and using a determined pressure and heat to cause the elastomeric material to fill the negative plate, thus creating the array, At this point, the elastomeric backing layer can be removed from the metal plate or mold and subsequently laminated to the decorative layer, or the decorative layer can be placed onto the elastomeric coated metal plate or mold and laminated to the decorative layer using heat and pressure, and subsequently removed. The array pattern may be machined into the aluminum plate to the desired depth and shape of the projections. The machining tool is often equipped with the desired concave surface and width of annular projections 5. There are many ways to manufacture the backing layer 3. Another method involves preparing a polymeric elastomeric layer, and mechanically embossing the layer using an embossing roll or plate to produce the selected array of Step 2. This process can be utilized with thermoplastic and thermoset elastomeric compositions. Generally, the thermoset elastomer layer will be embossed before final curing of the thermoset elastomeric composition.

Lamination of decorative layer 2 and the backing layer 3 with the array of annular projections 5 can be accomplished by many known techniques. In addition to utilizing heat and pressure to accomplish the lamination, the use of an adhesive layer between the decorative layer and the base layer may be required. Many adhesive options exist for this purpose. The only requirement of the adhesive is that it is compatible with the decorative layer 2 and backing layer 3, and provides acceptable performance during the lifetime of the installed decorative floor tile. It is understood that backing layer 3 can be manufactured in sheet form and multiple decorative layers 2 laminated thereto.

It is also understood, that if in the process utilizing the negative metal plate, elastomeric material is only placed within the geometric shapes within the metal plate, and little if any applied over the remaining areas of the plate, it would be possible to transfer only the annular projections 5 to the underside of the decorative layer 2. In this case the backing layer would comprise only the geometric projections 5 with a height 16 extending from the underside of decorative layer 2.

The proceeding description of the invention has shown and described certain embodiments thereof; however, it is intended by way of illustration and example only and not by way of limitation. Those skilled in the art should understand that various changes, omissions and additions may be made to the invention without departing from the spirit and scope of the invention as defined by the claims.

What is claimed is:

1. An adhesiveless decorative floor tile including at least one decorative layer and a backing layer comprising: an array of resilient cylindrical projections that project outwardly from a planar outer surface of said backing layer, wherein each cylindrical projection defines a blind passageway having a cylindrical open end with an enclosed portion of said outer surface of said backing layer forming a cylindrical closed end and arranged so that when pressure is applied to said decorative layer, a partial vacuum is formed within each said blind passageway allowing said decorative floor tile to remain in place on a surface in the absence of adhesive.

2. The adhesiveless decorative floor tile of claim 1, wherein the decorative layer is selected from the group consisting of resilient tile, plank, sheet products, and laminate plank or tile products.

3. The adhesiveless decorative floor tile of claim 2, wherein the resilient tile is a Luxury Vinyl Tile and the resilient plank is a Luxury Vinyl Plank.

4. The adhesiveless decorative floor tile of claim 1, wherein said cylindrical projections are symmetrical.

5. The adhesiveless decorative floor tile of claim 1, wherein said array of said cylindrical projections is organized in rows parallel to edges of said decorative layer and separated from one another by a predetermined distance.

6. The adhesiveless decorative floor tile of claim 5, wherein alternating rows of said cylindrical projections are offset from one another.

7. The adhesiveless decorative floor tile of claim 1, comprising 2,000 to 6,000 of said cylindrical projections per square foot of the backing layer.

8. The adhesiveless decorative floor tile of claim 1, wherein the decorative layer comprises a Laminate product.

9. A Luxury Vinyl Tile or Plank Flooring comprising a backing layer having a patterned array of elastomeric, geometric projections that project outwardly from a planar outer surface of said backing layer, wherein each geometric projection comprises a concave top surface, an outside wall surface and an inside wall surface wherein the inside wall surface defines a hollow area within the projection wherein said concave top surface forms at least a portion of said planar outer surface of said backing layer.

10. The Luxury Vinyl Tile or Plank of claim 9, wherein the geometric projections are in the form of circles/rings and wherein the pattern array of geometric projections is organized in rows parallel to the edges of the Luxury Vinyl Tile or Plank and separated from each other by a defined distance.

11. The Luxury Vinyl Tile or Plank of claim 10, wherein alternating rows of the pattern array are off-set from each other by a defined distance.

* * * * *